US010502517B1

(12) United States Patent
Ellis, Jr.

(10) Patent No.: US 10,502,517 B1
(45) Date of Patent: Dec. 10, 2019

(54) DOUBLE HELIX ANTI-PHASED ARCHERY LIMB

(71) Applicant: EXERGY OUTDOORS L.L.C., Canton, OH (US)

(72) Inventor: Paul David Ellis, Jr., Canton, OH (US)

(73) Assignee: Exergy Outdoors L.L.C., Canton, OH (US)

( * ) Notice: Subject to any disclaimer, the term of this patent is extended or adjusted under 35 U.S.C. 154(b) by 0 days.

(21) Appl. No.: 14/337,387

(22) Filed: Jul. 22, 2014

Related U.S. Application Data

(60) Provisional application No. 61/857,001, filed on Jul. 22, 2013.

(51) Int. Cl.
*F41B 5/14* (2006.01)
*F41B 5/10* (2006.01)

(52) U.S. Cl.
CPC ..... *F41B 5/1403* (2013.01); *F41B 5/10* (2013.01)

(58) Field of Classification Search
CPC .. A61F 2/60; A61F 2/66; F41B 5/0052–0068; F41B 5/10; F41B 5/12; F41B 5/14; F41B 5/20; F41B 5/1403; A63B 21/02
USPC ..... 124/25, 86, 87, 88, 89, 23.1–25.7; 473/422, 417, 451, 586, 587; 267/168
See application file for complete search history.

(56) References Cited

U.S. PATENT DOCUMENTS

| | | | | | |
|---|---|---|---|---|---|
| 428,912 | A * | 5/1890 | Holmes | F41B 5/0005 | 124/23.1 |
| 3,486,495 | A * | 12/1969 | Allen | F41B 5/10 | 124/25.6 |
| 4,338,909 | A * | 7/1982 | Plummer | F41B 5/0094 | 124/16 |
| 4,350,138 | A * | 9/1982 | Caldwell | F41B 5/10 | 124/25.6 |
| 4,458,657 | A * | 7/1984 | Stockmar | F41B 5/0094 | 124/17 |
| 4,644,929 | A | 2/1987 | Peck | | |
| 5,503,135 | A * | 4/1996 | Bunk | F41B 5/0094 | 124/16 |
| 5,944,302 | A * | 8/1999 | Loc | F04B 35/045 | 267/180 |
| 6,055,974 | A * | 5/2000 | Dieziger | F41B 5/10 | 124/23.1 |
| 6,536,421 | B1 * | 3/2003 | Jenkins | F41B 5/0073 | 124/23.1 |
| 7,703,449 | B2 | 4/2010 | Wright | | |
| 8,079,353 | B2 * | 12/2011 | Davis | F41B 5/0026 | 124/23.1 |
| 8,459,244 | B2 | 6/2013 | Yehle | | |
| 8,789,519 | B2 * | 7/2014 | Nebergall | F41B 5/10 | 124/25.6 |
| 2004/0077440 | A1 | 4/2004 | Kronfeld | | |

(Continued)

FOREIGN PATENT DOCUMENTS

WO WO 2010/042371 A1 4/2010

*Primary Examiner* — Melba Bumgarner
*Assistant Examiner* — Laura Davison
(74) *Attorney, Agent, or Firm* — Renner, Kenner Co. LPA

(57) ABSTRACT

A limb for an archery bow includes a first member in the form of a helix and a second member in the form of a helix. The bow includes a riser and spaced cams, wheels or limb tips carrying a bow string. The first and second members extend between the riser and a cam, wheel or limb tip.

10 Claims, 8 Drawing Sheets

(56) References Cited

U.S. PATENT DOCUMENTS

| | | | | |
|---|---|---|---|---|
| 2007/0012304 | A1* | 1/2007 | van Dorsser | F41B 11/53 124/51.1 |
| 2007/0131841 | A1 | 6/2007 | Gallops, Jr. | |
| 2008/0207362 | A1* | 8/2008 | Kuhn | F42B 10/24 473/586 |
| 2008/0216804 | A1 | 9/2008 | Mancini | |
| 2011/0220085 | A1* | 9/2011 | Christensen | F41B 5/0005 124/25.6 |
| 2012/0192843 | A1* | 8/2012 | Batdorf | F41B 5/10 124/25.6 |

* cited by examiner

DOUBLE HELIX ANTI-PHASED ARCHERY LIMB

CROSS-REFERENCE TO RELATED APPLICATIONS

This application claims the benefit of U.S. provisional patent application Ser. No. 61/857,001 entitled "Double Helix Anti-Phased Archery Limb," filed Jul. 22, 2013, and incorporated by reference in its entirety.

FIELD OF THE INVENTION

The present invention relates generally to a double helix limb design for archery bows and crossbows that utilizes wave mechanics, specifically destructive interference, to reduce unwanted movements and sound while increasing efficiency.

BACKGROUND OF THE INVENTION

Due to undesired motion and sound, modern archery limbs are capable of attaining at most 70-85% efficiency. The 70-85% efficiency results from energy losses that occur from harmonic oscillations, motion, and sound generated in the limbs as an arrow is released. Ideally, potential energy that is stored in the bending of the limbs is transferred to an arrow by means of the archery string. However, much energy is lost to mechanical resonance in the bow and its component parts. High-speed video capture of archers have shown oscillations and general shaking in the riser, limbs, and wheels of a bow. This is due to a shock wave caused by mechanical resonance that occurs at the end of the power-stroke. This shockwave reverberates within the system due to the linear shape of the limb. This phenomenon is identical to that of a tuning fork.

This lost energy is also embodied audibly and the sound can reach up to 100 decibels when a bow is fired. Visually, this represents wasted energy that, rather than being transferred to an arrow, is instead dissipated into the bow itself as vibration and into the surrounding environment acoustically. In addition to being inefficient, this becomes a safety hazard in the event of a dry fire, defined as releasing from a power stroke without a knocked arrow. There exists a need in the art to eliminate energy loss in the archery process, specifically sound and vibration.

SUMMARY OF THE INVENTION

Therefore, it is an object of the present invention to reduce the mechanical resonance that is associated with archery constructions found in the prior art.

It is another object of the present invention to reduce the noise created by archery constructions of the prior art.

These and other objects of the present invention, as well as the advantages thereof over existing prior art forms, which will become apparent from the description to follow, are accomplished by the improvements hereinafter described and claimed.

In general, a limb for an archery bow made in accordance with the present invention includes a first member in the form of a helix and a second member in the form of a helix.

An archery bow made in accordance with the present invention includes a riser and spaced cams carrying a bow string. A limb in the form of a double helix extends from each end of the riser to the cam.

A preferred exemplary archery bow limb according to the concepts of the present invention is shown by way of example in the accompanying drawings without attempting to show all the various forms and modifications in which the invention might be embodied, the invention being measured by the appended claims and not by the details of the specification.

PREFERRED EMBODIMENTS FOR CARRYING OUT THE INVENTION

An archery bow made in accordance with the present invention is indicated generally by the numeral 10 and is shown in FIGS. 1-4. Bow 10 includes a first limb 12 and a second limb 14, each of which are formed of a first member 16*a* in the configuration of a helix and a second member 16*b* in the configuration of a helix. With respect to the first limb 12, the paired first member 16*a* and second member 16*b* are in-polarity with one another, but are out of phase with each other. With respect to the second limb 14, not only are the paired first member 16*a* and second member 16*b* out of phase and in-polarity with each other, but also they are considered to be out of polarity with respect to the first limb 12. In the present invention, the term "in-polarity" is defined as configuring the helix of the first member 16*a* and the helix of the second member 16*b* to rotate in the same direction as each other, either clockwise or counter-clockwise. The term "out of polarity" is defined as configuring the helix of the first member 16*a* in one direction, either clockwise or counterclockwise, and the helix of the second member 16*b* being configured in the opposite direction, either counter-clockwise or clockwise. The term "out of phase" is defined as configuring the helix of the first member 16*a* and the helix of the second member 16*b* such that the helix of the second member starts its rotation phased by 180 degrees from the helix of the first member. Even while out of phase with each other, the helix of the first member 16*a* and the helix of the second member 16*b* continue to maintain identical directional rotation.

Figure 1:
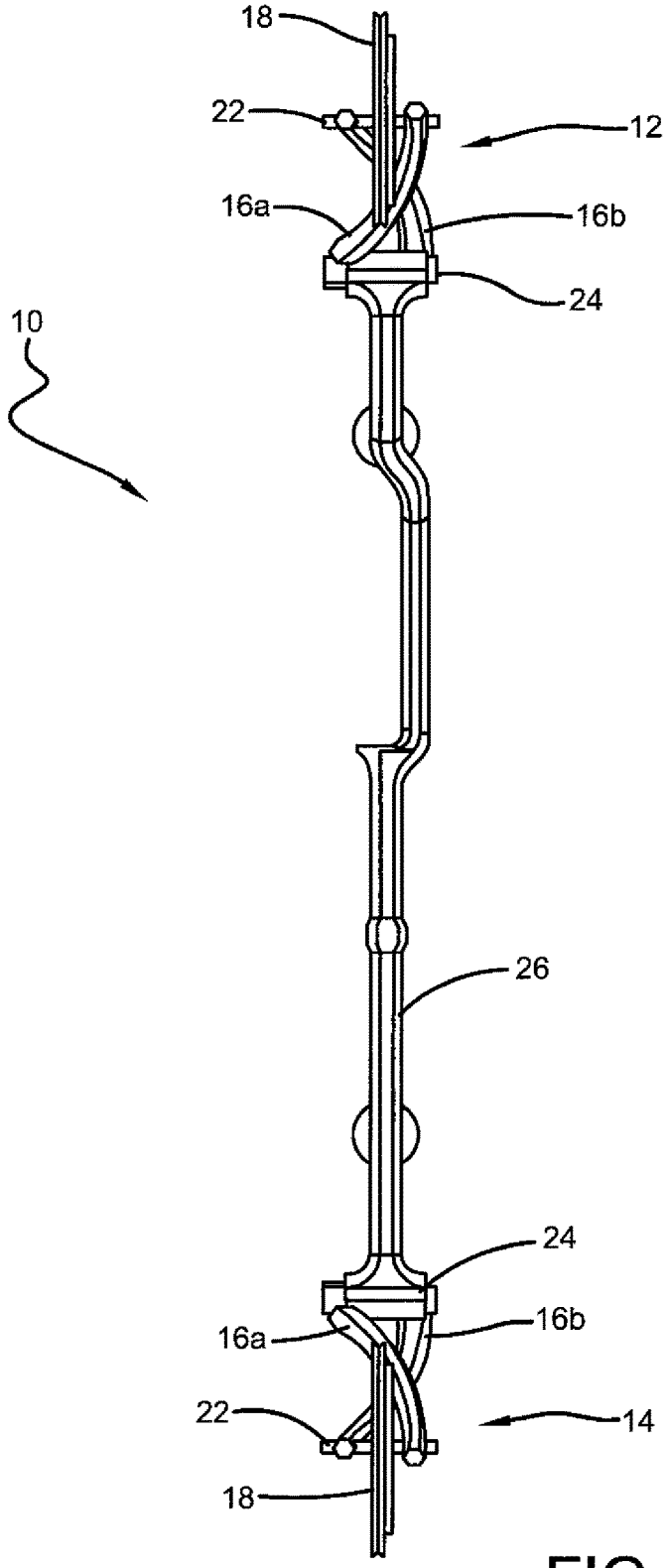
FIG. 1 is a rear elevational view of a bow using the double helix limb design of the present invention.
Figure 2:
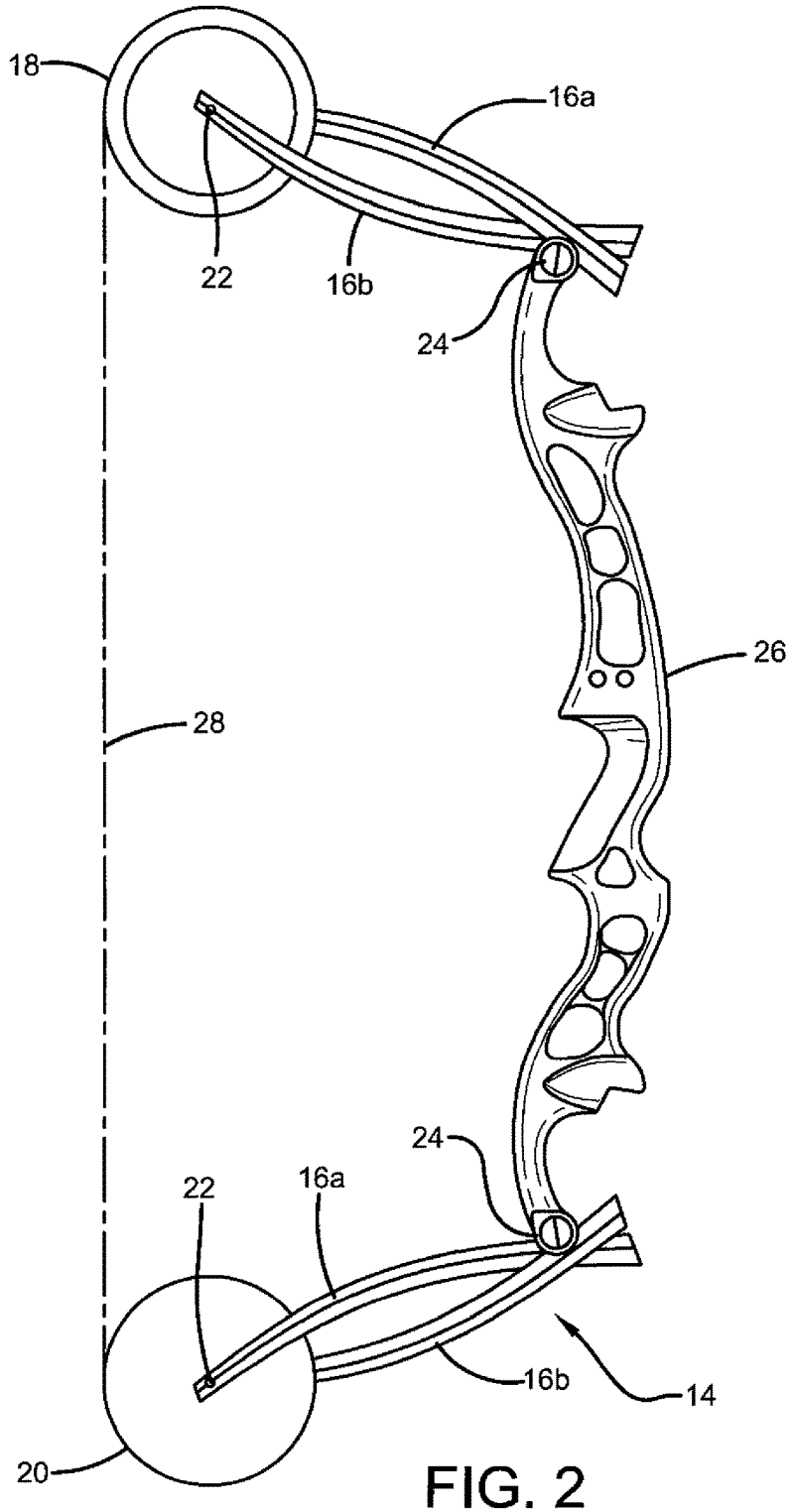
FIG. 2 is a side elevational view of a bow using the double helix limb design of the present invention.
Figure 3:
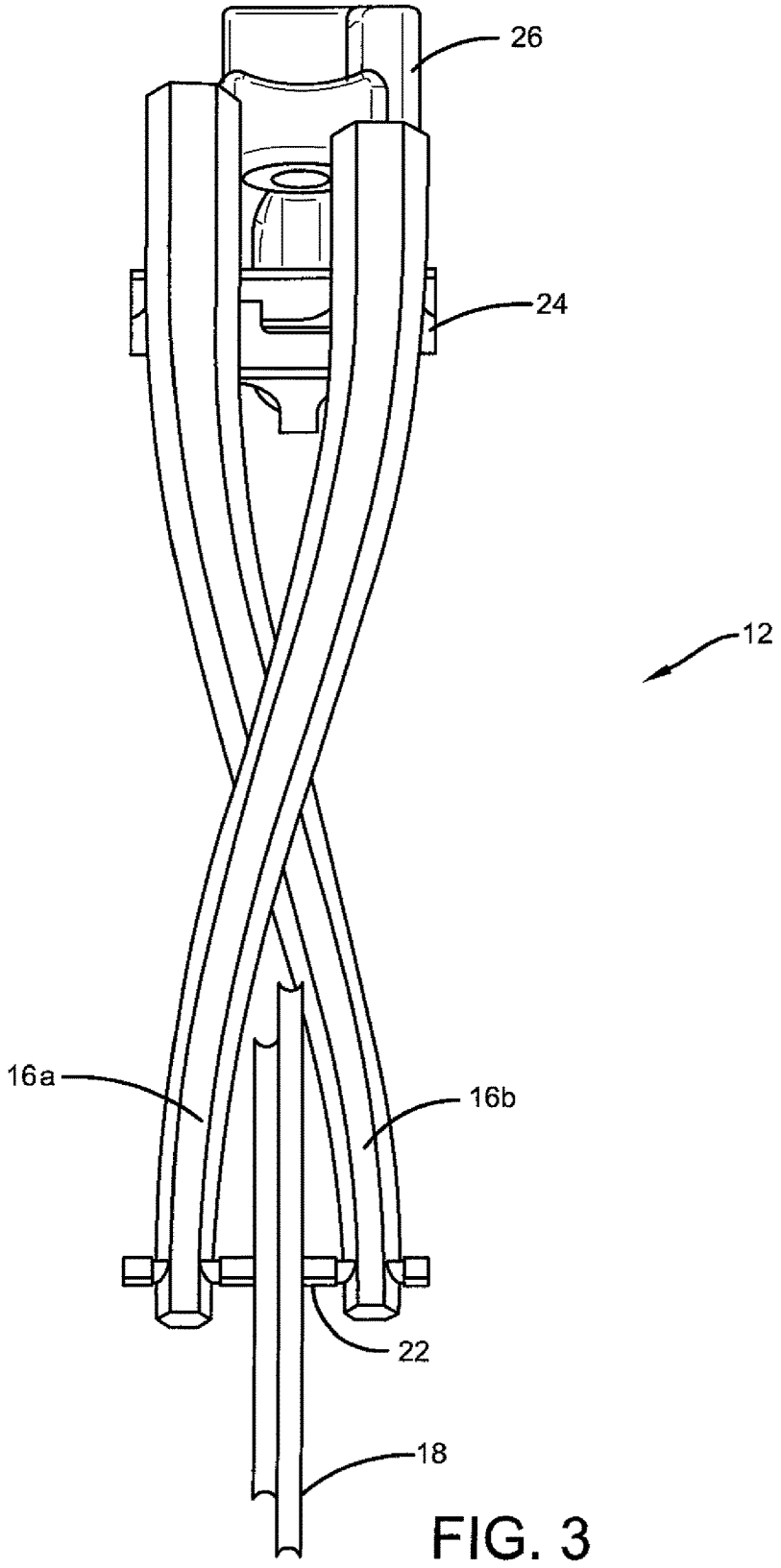
FIG. 3 is a top plan view of a limb of a bow using the double helix limb design of the present invention.
Figure 4:
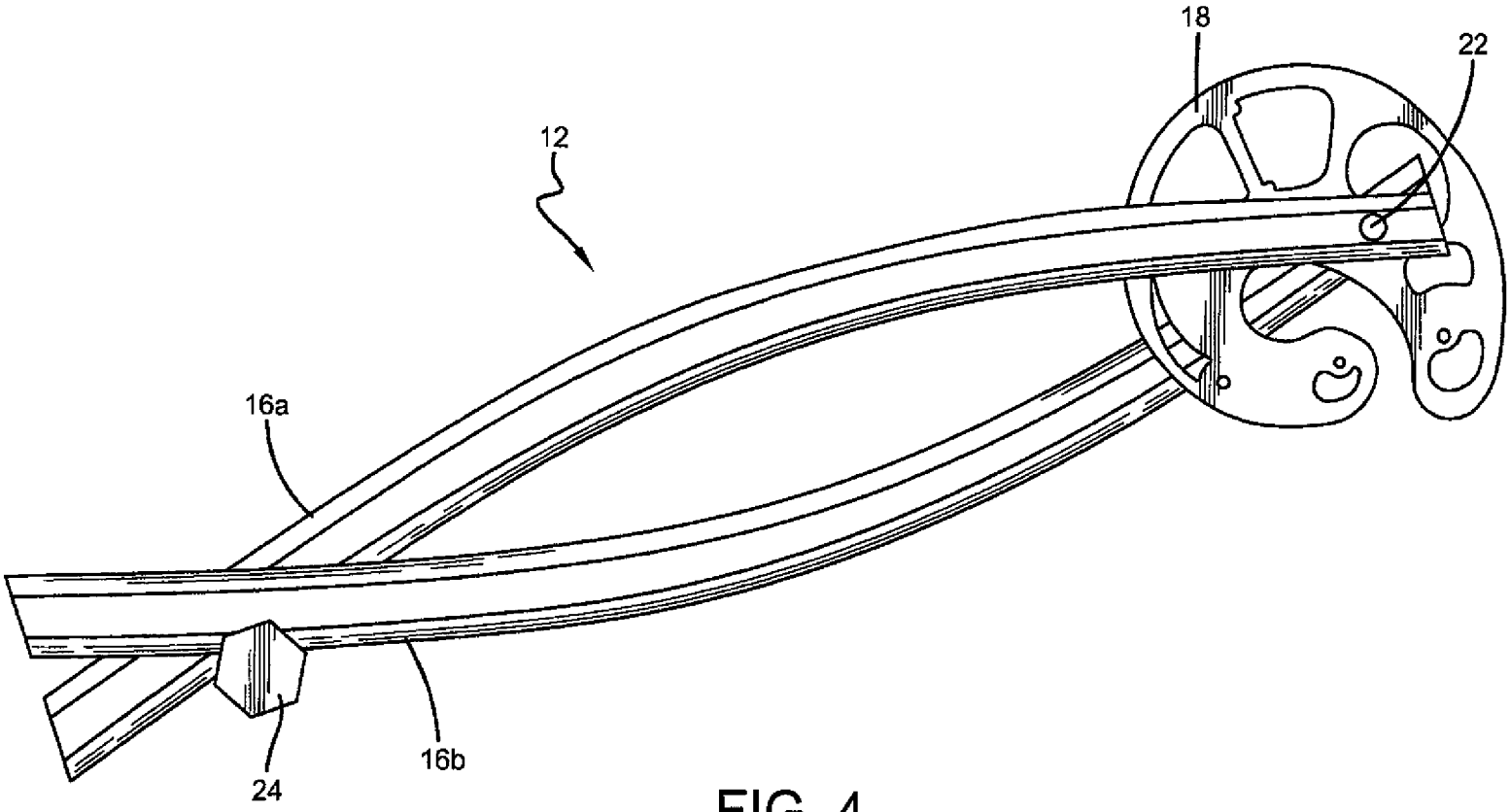
FIG. 4 is a side elevational view of a limb of a bow using the double helix limb design of the present invention.

The tip of each limb 12, 14 may carry a cam 18 or a wheel 20 (both a cam and a wheel are shown in FIG. 2 as they are virtually interchangeable with one another), which are rotatable on an axle 22. Limbs 12 and 14 are connected to a riser 26 at a fulcrum pivot point 24 and a limb anchor point (not shown). Thus, the riser 26 is located between the first limb 12 and the second limb 14. A bowstring 28 extends between the tips of each limb 12 and 14, and if the tips have a cam 18 or wheel 20, then the bowstring 28 would extend around the cam 18 or wheel 20. Although both are not shown in the drawings, each bow 10 employs both a limb anchor point, which connects the limb to the riser to prevent the rear portion of the limb from moving, and a pair of cables, which are used to compress the limbs 12 and 14 as the cam 18 and/or wheel 20, rotates. The limb anchor point is located on the limb at the end of the portion of the limb not connected by the axle 22. In one embodiment, one end of one of the cables attaches to the cam 18 and/or wheel 20 of the first limb 12, and the other end of the cable attaches to the second limb 14 and vice versa with the other cable. When the bow string 28 is drawn back, the cables are taken up on the cam 18 and/or wheel 20 as it rotates and this action pulls on the opposite limb to provide compression of the limb.

Figure 6:
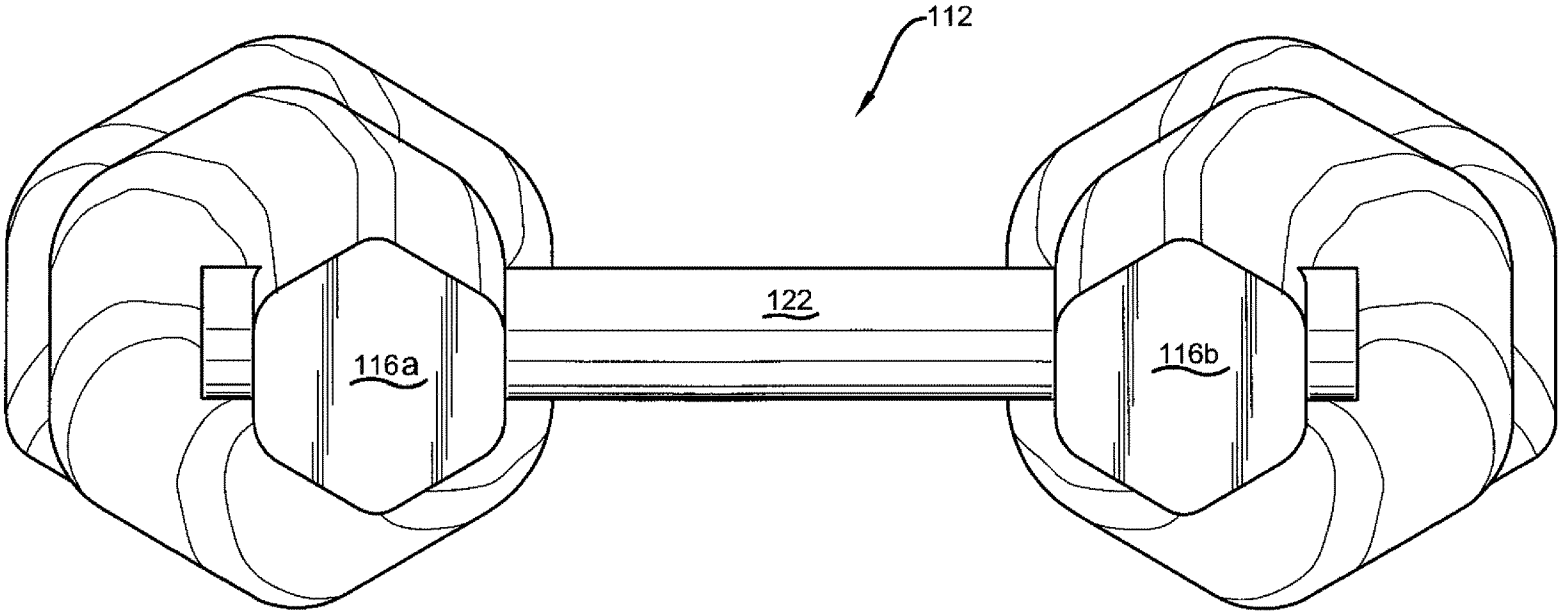
FIG. 6 is a front elevational view of an alternative embodiment of a limb of a bow using the double helix limb design of the present invention.
Figure 7:
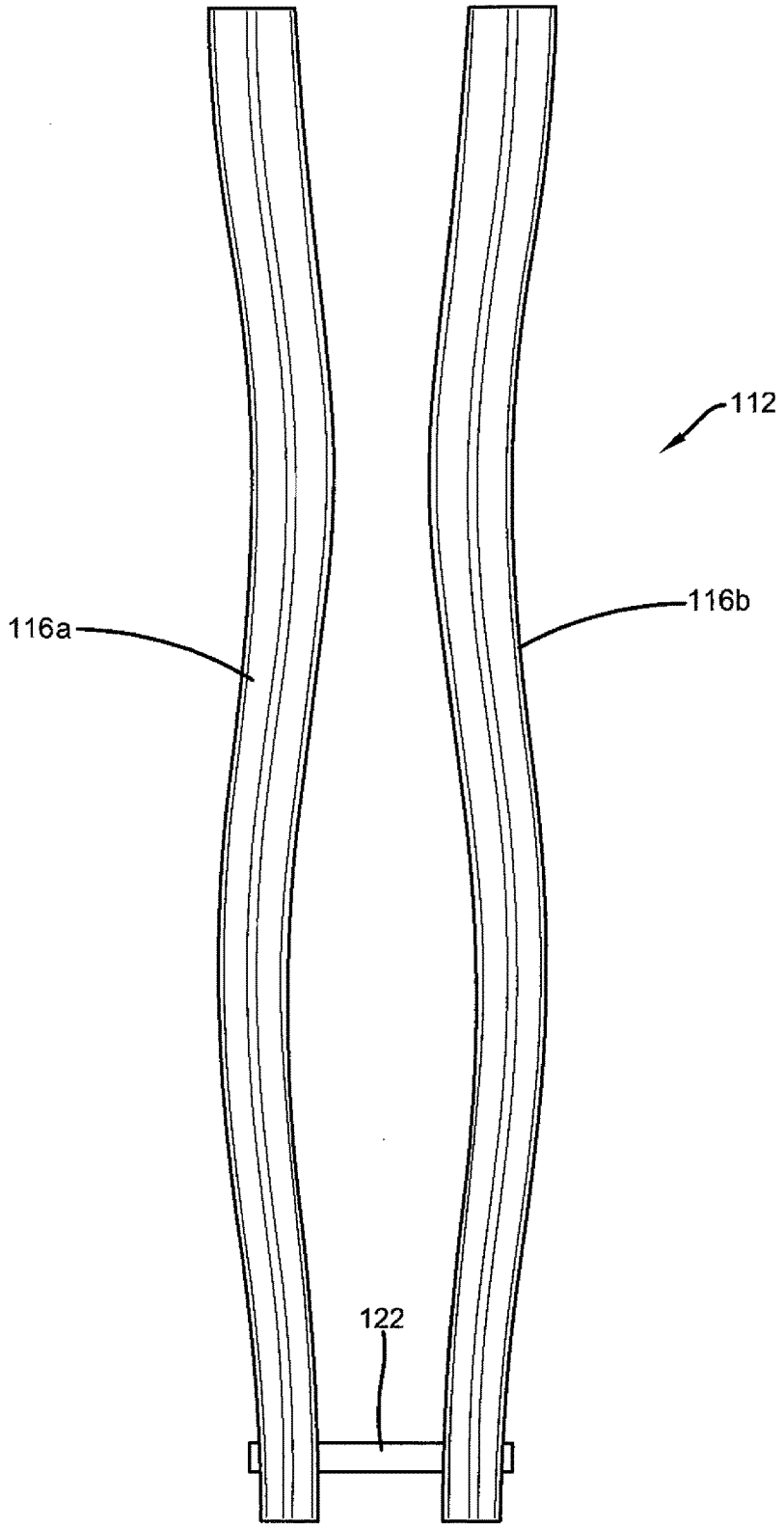
FIG. 7 is a top plan view of an alternative embodiment of a limb of a bow using the double helix limb design of the present invention.
Figure 8:
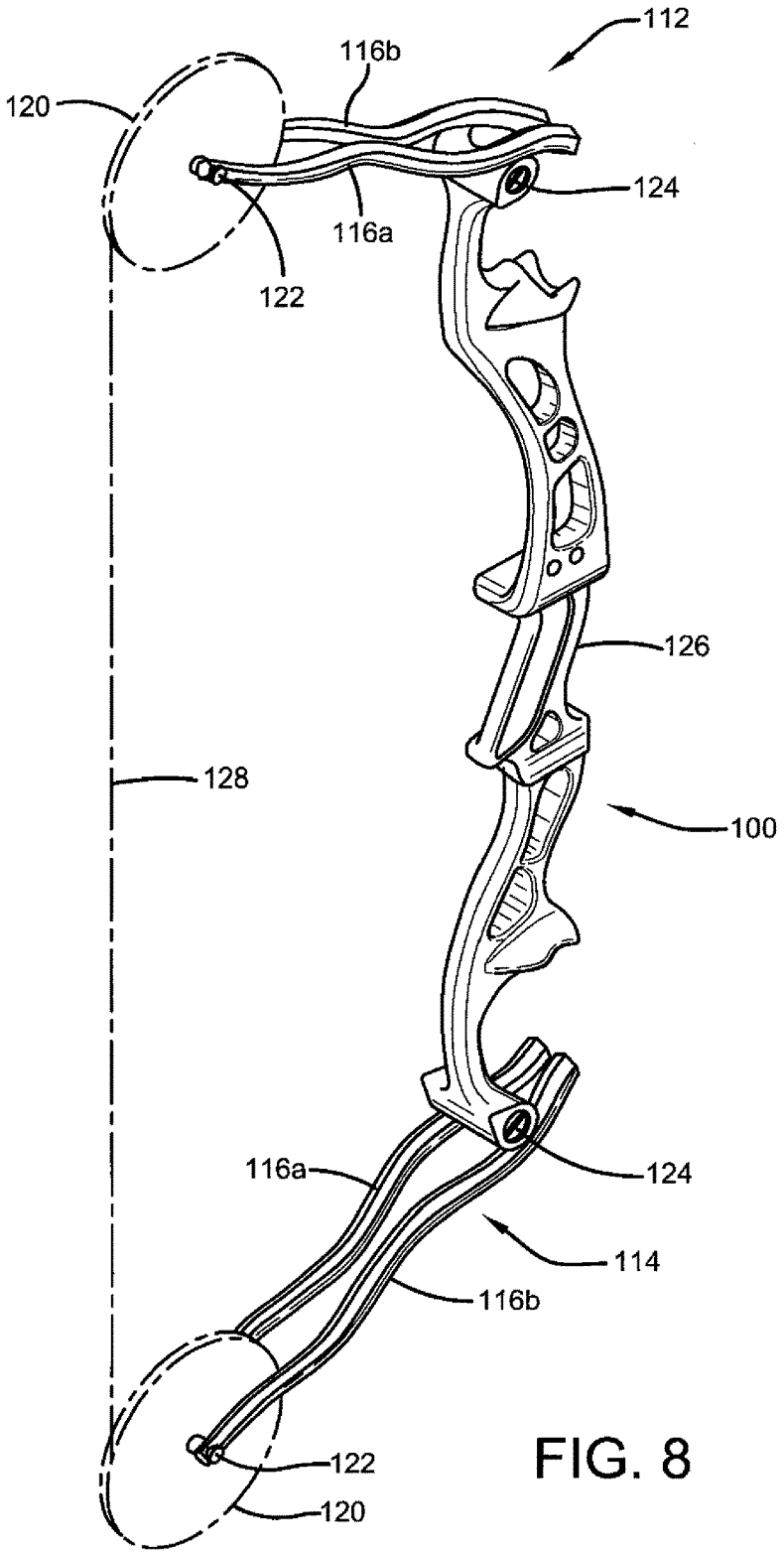
FIG. 8 is an isometric elevational view of a bow using an alternative embodiment of the double helix limb design of the present invention.

In an alternative embodiment shown in FIGS. 6 through 8, a first limb 112 and a second limb 114 are configured as double helical limbs, each of which includes a pair of anti-phased helixes 116*a* and 116*b*. With respect to the first limb 112, the paired first member 116*a* and second member 116*b* are out of polarity with one another, as well as being out of phase with each other. In a traditional bow 100, the first limb 112 is used with a second limb 114 which also has a pair of anti-phased helixes, 116*a* and 116*b*. Each limb 112, 114 may carry a cam or wheel 120, which are rotatable on an axle 122. Limbs 112 and 114 are connected to a riser 126 at a fulcrum pivot point 124 and a limb anchor point (not shown). Thus, the riser 126 is located between the first limb 112 and the second limb 114. A bow string 128 extends between the tips of the limbs 112 and 114 having cams or wheels 120 of the first limb 113 and the second limb 114. Although both are not shown in the drawings, each bow 100 employs both a limb anchor point, which connects the limb to the riser to prevent the rear portion of the limb from moving, and a pair of cables, which are used to compress the limbs 112 and 114 as the wheel 120, rotates.

The specified polarizations and phase shifts of the first member 16*a* and the second member 16*b* of both the first limb 12 and the second limb 14, or of the first helix 116*a* and the second helix 116*b* of both the first limb 112 and the second limb 114 is requisite for the proper function of the efficiency improvements offered by the present invention. Each individual member, 16*a* or 16*b* and 116*a* or 116*b*, is constructed from a geometric tube or rod and they may be either solid or hollow. In one embodiment, the material used to make each individual member, 16*a* or 16*b* and 116*a* or 116*b*, is selected from the group consisting of chopped or continuous strands of high strength composite material. Potentially, rather than be constructed from more basic circular tubes, each individual member, 16*a* or 16*b* and 116*a* or 116*b*, can be formed from specific geometric polygons in order to further control the propagation of mechanical resonance. In a further embodiment, this is accomplished by utilizing a round or polygonal rod or tube, which is linearly twisted, shaped or spiraled in an arc pattern so that it has the property of a curve on a plane that winds around or in and out of a fixed center point at a continuously increasing or decreasing distance from the point; that is, a spiral, or a three-dimensional curve that turns around an axis at a constant or continuously varying distance while moving parallel to the axis; that is, a helix.

The helical construction of the first limb 12 or 112 and the second limb 14 or 114 is intended to create a coherent anti phased relationship between each limb and each pair of limbs so that the first and second limb, create destructive interference patterns when they vibrate as a whole. As the bow 10 or 100 is drawn, the elastic energy in the first limb 12 or 112 and the second limb 14 or 114 stacks until the archer reaches full draw. At this point the arrow is released and the stored elastic potential in the first limb 12 or 112 and the second limb 14 or 114 transfers energy to the bow string 28 or 128. As the arrow is released at the end of the power stroke, the system is seeking equilibrium. This is the moment where the audible transient occurs along with the mechanical shockwave of bows found in the prior art. Vibration and sound are physical and audible representations of potential energy being lost, bows not using the spiraled or helical construction of the present invention will be less efficient due to the linear way in which they store and release elastic potential energy and the way in which they vibrate constructively when they reach equilibrium.

Figure 5:
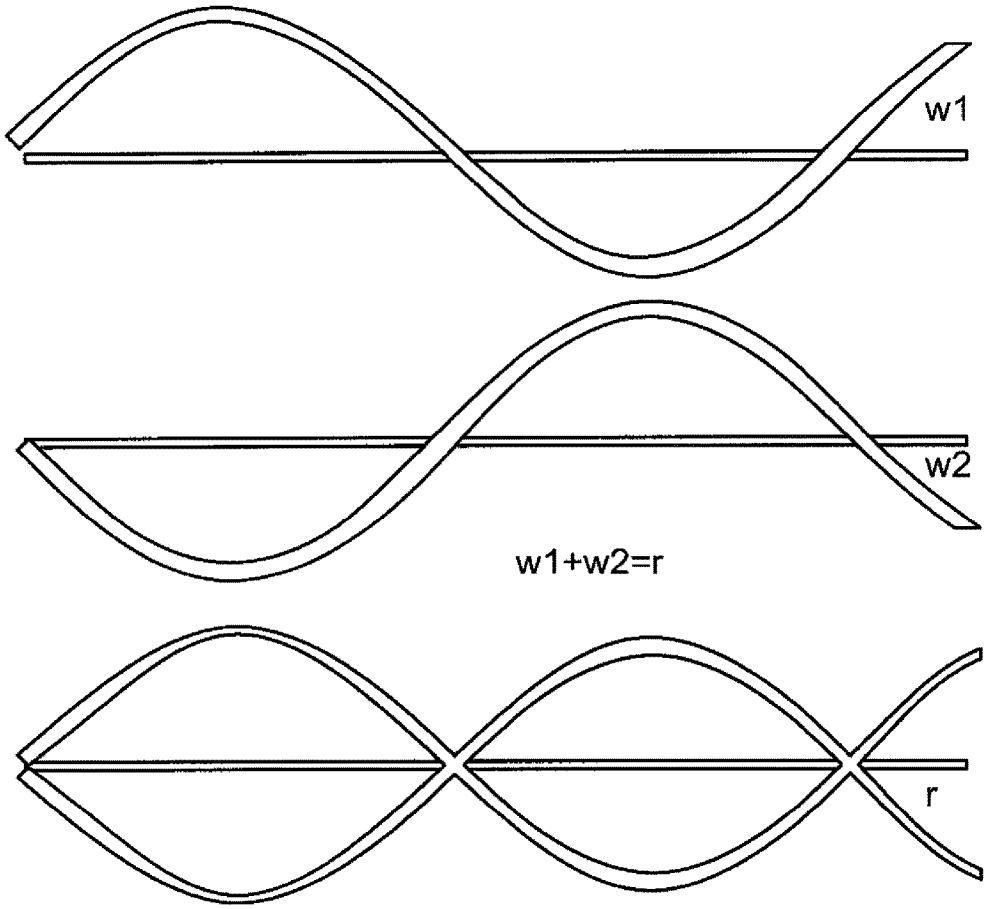
FIG. 5 is an example of a destructive interference pattern.

The spiraled or helical construction of the present invention, on the other hand, mitigates such inefficiencies by providing phase shifted or pole shifted spirals or helixes. Since each member 16*a* or 116*a* is shifted from its paired member 16*b* and 116*b*, meaning that the second helix is 180 degrees out of phase or out of polarity from the first helix, the resonant interference patterns of each helix in a limb as it propagates waves will be destructive in nature. This causes the vibration of the first limb 12 or 112 to cancel the vibrations of the second limb 14 or 114 on a mechanical level. This destructive interference pattern is visualized in FIG. 5. Destructive interference occurs when the interference of two waves of equal frequency and opposite phase or polarity, result in their cancellation where the negative displacement of one always coincides with the positive displacement of the other. The principle of superposition of waves states that when two or more propagating waves of same type are incident on the same point, the total displacement at that point is equal to the sum of the displacements of the individual waves. If a crest of a wave meets a crest of another wave of the same frequency at the same point, then the magnitude of the displacement is the sum of the individual magnitudes—this is constructive interference. If a crest of one wave meets a trough of another wave then the magnitude of the displacements is equal to the difference in the individual magnitudes—this is known as destructive interference.

Effectively, by being out of phase or out of polarity the acoustical energy from one helix phase cancels out the acoustical energy from the other helix, greatly reducing resonance and allowing for the increase in stored potential energy being transferred to the arrow. Essentially, the design of the present invention capitalizes upon the properties of wave mechanics to greatly reduce fluctuations in the limbs of a bow during the power stroke, resulting in an increase of potential energy and subsequently a higher efficiency. This can be applied to various bow and crossbow designs to offer an improvement over current bow and crossbow limb designs. As the first limb 12 or 112 and second limb 14 or 114 resonate, they propagate waves that create destructive interference patterns. These interference patterns naturally cancel mechanical vibration and sound.

In light of the foregoing, it should be appreciated that the present invention significantly advances the art by providing a double helix limb design for bows and crossbows that is structurally and functionally improved in a number of ways. While particular embodiments of the invention have been disclosed in detail herein, it should be appreciated that the invention is not limited thereto or thereby inasmuch as variations on the invention herein will be readily appreciated by those of ordinary skill in the art. The scope of the invention shall be appreciated from the claims that follow.

What is claimed is:

1. A limb assembly for an archery bow, the limb assembly comprising a riser, an axle, a cam, a first limb member in the form of a helix, and a second limb member in the form of a helix wherein a first end of the first limb member and a first end of the second limb member are connected to one end of the riser and a second end of the first limb member and a second end of the second limb member are fixed to the axle, wherein said cam is positioned on said axle so that said cam is rotatably journaled on said axle, wherein an entirety of said first limb member and said second limb member maintains a helical rotation of 180° or more between said first ends and said second ends of said first and second limb members and wherein said first limb member and said second limb member do not contact one another.

2. The limb assembly of claim 1, wherein the first limb member is out of phase with the second limb member.

3. The limb assembly of claim 2, wherein the first limb member is out of polarity with the second limb member.

4. The limb assembly of claim 2, wherein the first limb member is in polarity with the second limb member.

5. The limb assembly of claim 1, wherein the one end of the riser has a fulcrum point.

6. The limb assembly of claim 1, wherein both the first limb member and the second limb member are made from high strength composite material.

7. A limb assembly for an archery bow, the limb assembly comprising a rigid riser, spaced axles, spaced cams, one of said spaced cams being positioned on and rotatably journaled on one of said spaced axles and the other of said spaced cams being positioned on and rotatably journaled on the other of said spaced axles, a first limb member in the form of a helix connected to one end of said riser and fixed to one of said spaced axles, a second limb member in the form of a helix connected to said one end of said riser and fixed to said one of said spaced axles, another first limb member in the form of a helix connected to another end of said riser and fixed to the other of said spaced axles, and another second limb member in the form of a helix connected to said other end of said riser and fixed to said other of said spaced axles, wherein the entirety of said first limb member is out of polarity with the entirety of said second limb member and the entirety of said another first limb member is out of polarity with the entirety of said another second limb member, and wherein the entirety of said first limb member, said second limb member, said another first limb member, and said another second limb member maintains a helical rotation of 180° or more.

8. The limb assembly of claim 7, wherein said first limb member is out of phase with said second limb member, and wherein said another first limb member is out of phase with said another second limb member.

9. The limb assembly of claim 7, wherein both said first limb member and said second limb member are made from high strength composite material, and wherein both said another first limb member and said another second limb member are also made from high strength composite material.

10. A limb assembly for an archery bow, the limb assembly having a riser, an axle, a first member in the form of a helix and a second member in the form of a helix wherein a first end of the first member and a first end of the second member are connected to one end of the riser and a second end of the first member and a second end of the second member are fixed to the axle, wherein an entirety of said first member and said second member maintains a helical rotation of 180° between said first ends and second ends of said first and second members, wherein said first member and said second member do not contact one another, and wherein said first member is connected to a left side of said one end of said riser and fixed to a right side of said axle and said second member is connected to a right side of said one end of said riser and fixed to a left side of said axle.

* * * * *